US009033065B2

(12) United States Patent
Viitaniemi et al.

(10) Patent No.: US 9,033,065 B2
(45) Date of Patent: May 19, 2015

(54) METHOD AND APPARATUS FOR CONTROLLING ROCK DRILLING

(75) Inventors: Jarno Viitaniemi, Tampere (FI); Vesa Peltonen, Tampere (FI); Markus Saarela, Tampere (FI); Juho Seppälä, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 745 days.

(21) Appl. No.: 13/380,545

(22) PCT Filed: May 28, 2010

(86) PCT No.: PCT/FI2010/050437

§ 371 (c)(1),
(2), (4) Date: Dec. 23, 2011

(87) PCT Pub. No.: WO2010/149839

PCT Pub. Date: Dec. 29, 2010

(65) Prior Publication Data

US 2012/0097449 A1 Apr. 26, 2012

(30) Foreign Application Priority Data

Jun. 26, 2009 (WO) ..... PCT/FI2009/050579

(51) Int. Cl.
*E21B 44/04* (2006.01)
*E21B 44/02* (2006.01)

(52) U.S. Cl.
CPC ..... *E21B 44/02* (2013.01); *E21B 44/04* (2013.01)

(58) Field of Classification Search
CPC ..... E21B 44/02; E21B 44/04; E21B 44/06
USPC ..... 175/24, 27; 173/3, 4, 6, 7, 8, 9, 11
See application file for complete search history.

(56) References Cited

U.S. PATENT DOCUMENTS 3,823,784 A 7/1974 Feucht
4,246,973 A * 1/1981 Mayer ..... 173/8

(Continued)

FOREIGN PATENT DOCUMENTS

FI 118306 B1 9/2007
JP 6-31522 4/1994

(Continued)

OTHER PUBLICATIONS

International Search Report for PCT/FI2010/050437, dated Sep. 16, 2010.

(Continued)

*Primary Examiner* — Giovanna C Wright
(74) *Attorney, Agent, or Firm* — Morgan, Lewis & Bockius LLP

(57) ABSTRACT

Method and apparatus for controlling rock drilling with a percussion device belonging to a rock drill to deliver stress waves to rock through a tool by pushing the tool against the rock by means of a feed motor and rotating simultaneously the tool by means of a rotation motor, whereby the maximum feed force is determined, pressure medium is supplied to the feed motor and to the rotation motor and the feed force is controlled according to the drilling conditions. The feed force is controlled on the basis of the feed speed and the rotation torque. The apparatus has a load control valve which controls the feed.

25 Claims, 3 Drawing Sheets

(56) References Cited

U.S. PATENT DOCUMENTS

| | | | | |
|---|---|---|---|---|
| 4,440,236 | A * | 4/1984 | Shiihara et al. | 173/8 |
| 5,913,371 | A | 6/1999 | Jenne | |
| 6,938,702 | B2 | 9/2005 | Saha et al. | |
| 7,654,337 | B2 | 2/2010 | Noël | |
| 8,091,652 | B2 * | 1/2012 | Sinnerstad et al. | 175/24 |
| 2008/0087467 | A1 | 4/2008 | Kemppainen | |

FOREIGN PATENT DOCUMENTS

| | | |
|---|---|---|
| JP | 8-158776 | 6/1996 |
| JP | 10-18750 | 1/1998 |
| JP | 11-173063 | 6/1999 |
| JP | 2006-510831 | 3/2006 |
| WO | WO 2004/042193 | 5/2004 |
| WO | 2008/127173 A1 | 10/2008 |
| WO | 2009/002306 A1 | 12/2008 |

OTHER PUBLICATIONS

Written Opinion of the International Search Report for PCT/FI2010/050437, dated Sep. 16, 2010.

Notification of Reason for Refusal (with English translation) for Japanese Patent Application 2012-516807, dated Sep. 3, 2013.

* cited by examiner

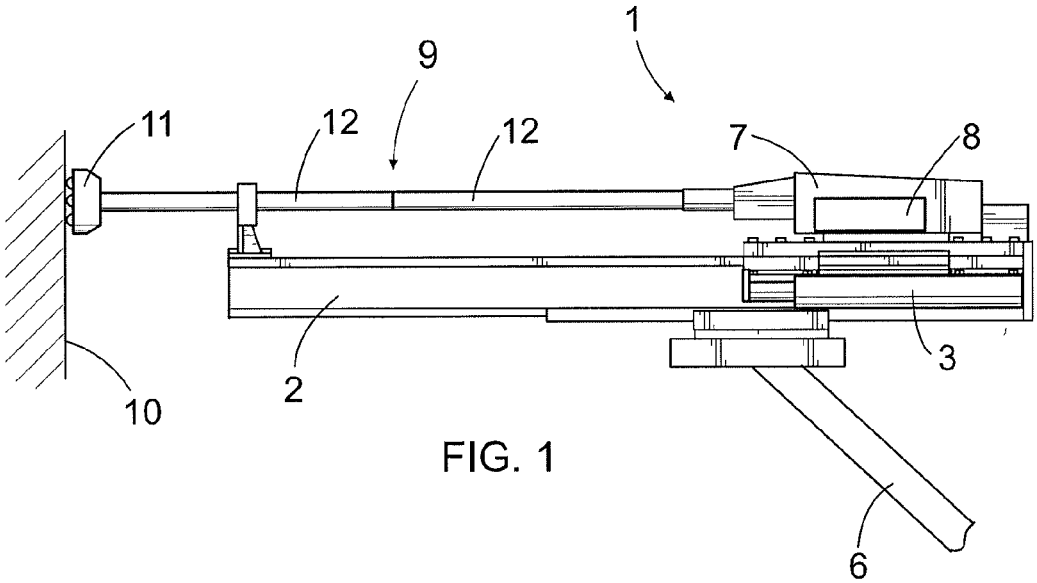
FIG. 1
Fig. 2
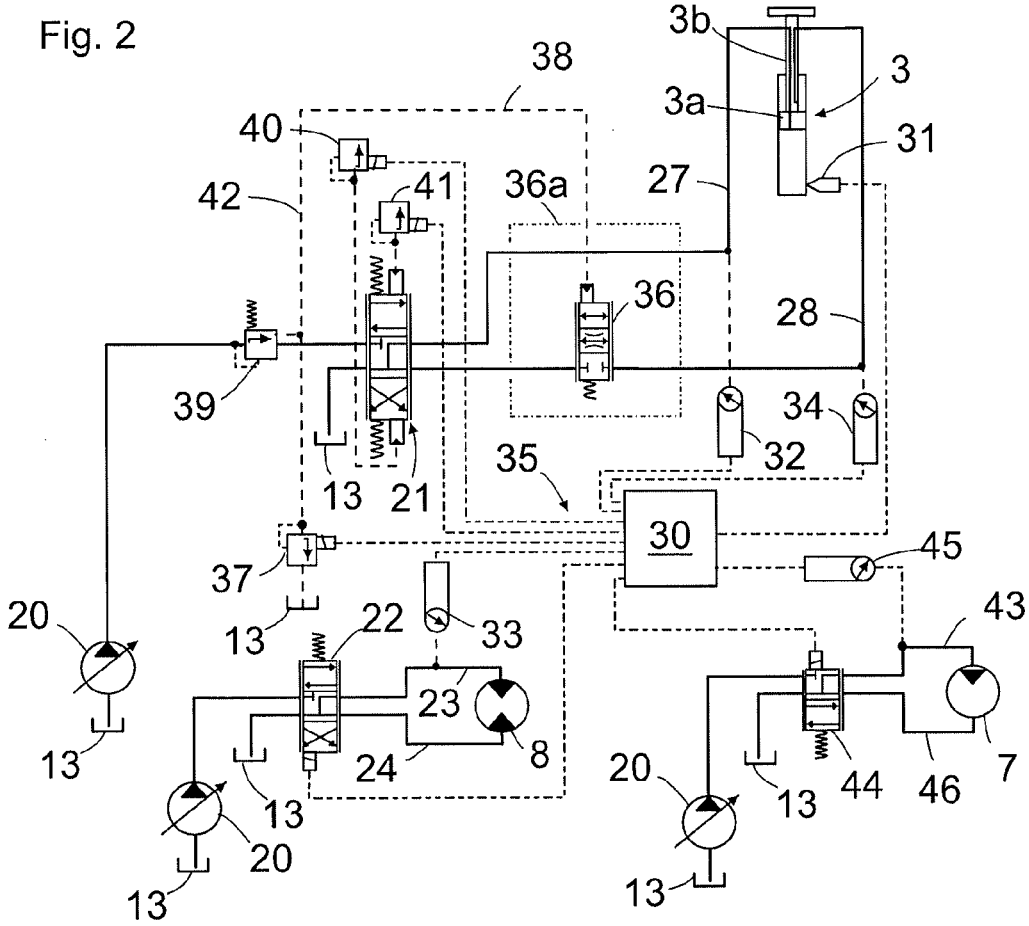

Fig. 3
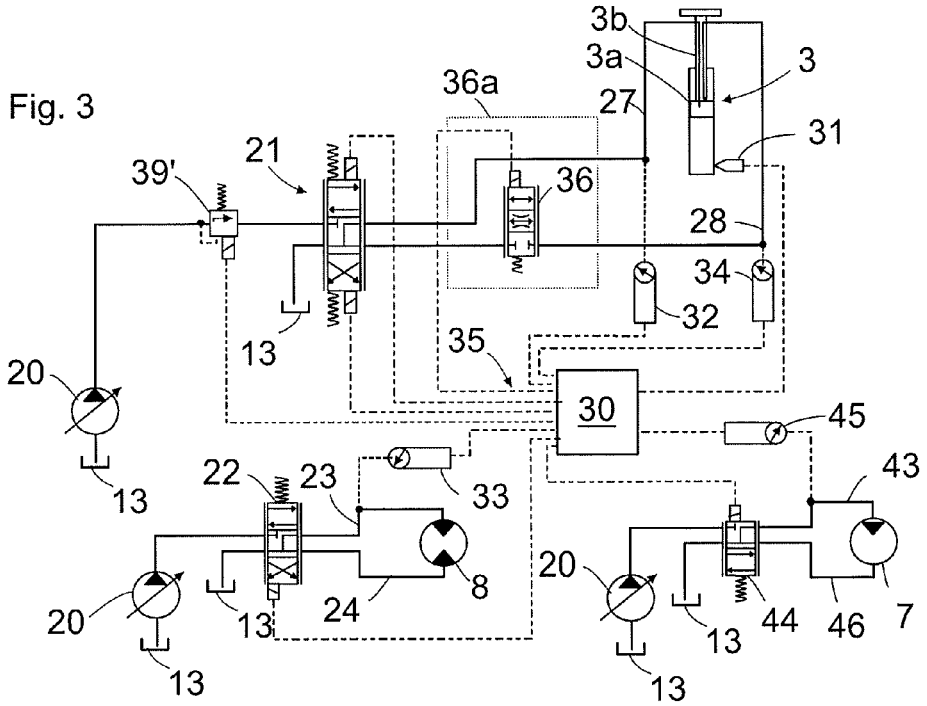
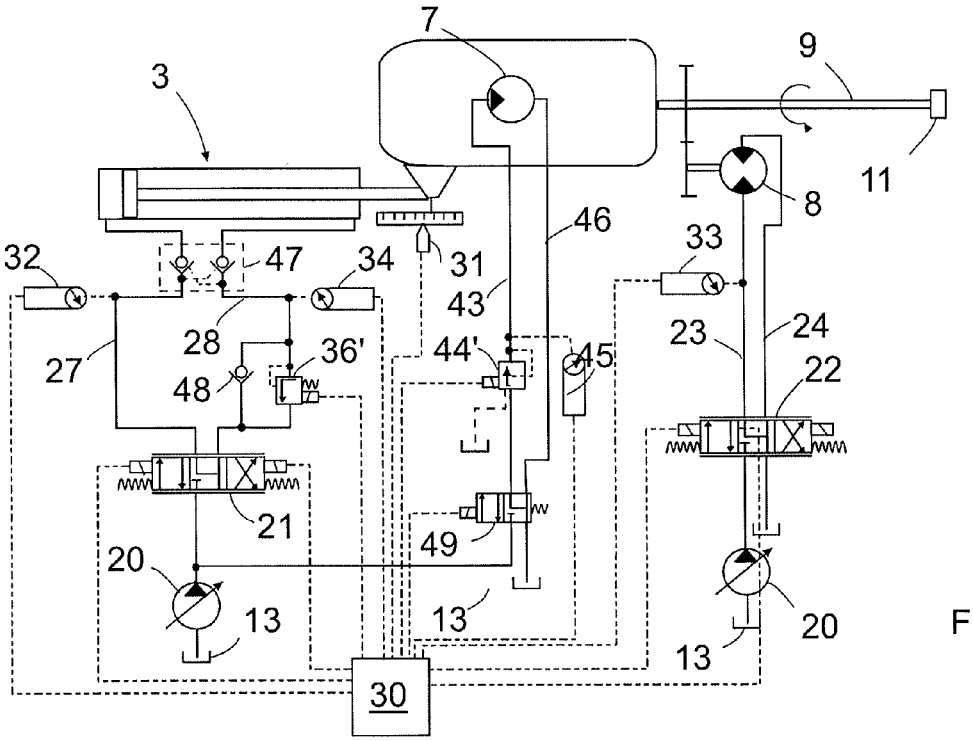
Fig. 4

METHOD AND APPARATUS FOR CONTROLLING ROCK DRILLING

RELATED APPLICATIONS

The present application is a U.S. National Phase Application of International Application No. PCT/FI2010/050437 (filed 28 May 2010) which claims priority to International Application No. PCT/FI2009/050579 (filed 26 Jun. 2009).

BACKGROUND OF THE INVENTION

The invention relates to a method for controlling rock drilling.

wherein a pressure liquid operated percussion device belonging to a rock drill machine delivers stress waves to rock through a tool; wherein the rock drill machine and the tool are simultaneously pushed against the rock by means of a feed motor, and the tool is simultaneously rotated by means of a rotation motor;

the method comprising:

determining the maximum feed force;

supplying pressure liquid to the feed motor along a feed pressure channel and away from the feed motor along a return channel;

supplying pressure liquid to the percussion device along a percussion device pressure channel and away from the percussion device along a return channel;

supplying pressure liquid to the rotation motor (8) along a rotation motor pressure channel and away from the rotation motor (8) along a return channel;

controlling the feed force in relation to the feed speed so that when the feed speed is increased the feed force is decreased and vice versa; and controlling the feed force in relation to the rotation torque so that when the rotation torque is increased the feed force is decreased and vice versa.

Further the invention relates to an apparatus for controlling rock drilling with a pressure liquid operated rock drilling machine, a drilling tool being attachable to the rock drilling machine, a percussion device) for creating stress waves to the tool, a percussion pressure channel and a percussion return channel (46) for supplying pressure liquid to the percussion device and away a rotation motor for rotating the tool, a rotation pressure channel and a rotation return channel for supplying pressure liquid to the rotation motor and away, a feed motor for feeding the rock drilling machine to the drilling direction and to reverse direction, a feed pressure channel and a feed return channel for supplying pressure liquid to the feed motor and away, a feed control valve for controlling the supply of the pressure liquid to the feed motor, a rotation control valve for controlling the supply of the pressure liquid to the rotation motor, a percussion control valve for controlling the supply of the pressure liquid to the percussion device, measuring equipment for measuring the feed speed and/or the feed position and to measure the pressure of the pressure liquid supplied to the feed motor and for measuring the pressure of the pressure liquid supplied to the rotation motor, and a control unit (30), to which the measuring equipment is connected and which is connected to control the feed control valve, the rotation control valve and the percussion control valve on the basis of the measured values.

When holes are drilled into rock, the drilling conditions may vary in several ways. The rock may include voids and cracks, and rock layers having different hardness, which is why drilling parameters should be adjusted according to the drilling conditions.

Conventionally, an operator controls the operation of a rock drill on the basis of his or her personal experience. The operator sets certain drilling parameters on the basis of the presumed rock characteristics. During drilling, the operator checks the rotation and monitors the progress of the drilling. When necessary, he changes the feed force and/or the percussion power of the percussion device to suit a particular type of rock, thus trying to achieve a fast but still smooth drilling process. In practice, the operator is able to adjust only one drilling parameter and control its influence on the drilling process in several seconds or tens of seconds. When the quality of rock or the drilling characteristics thereof changes rapidly, even a qualified operator cannot adapt the drilling parameters quickly enough to suit the rock. It is thus obvious that the operator cannot ensure a good tool life if drilling conditions vary rapidly. Furthermore, it is practically impossible even for a qualified operator to monitor and control the operation of the rock drilling machine during an entire working shift such that the drilling progresses efficiently at every moment, simultaneously taking into account the stresses the tool is subjected to.

Also in the down hole drilling there may exist an uncontrolled rush of the rock drill, when the force of the stone resisting the feed suddenly disappears for instance when the drill bit hits a hole in the rock. Further in this kind of drilling the hydraulics as such easily vibrates or oscillates which creates problems for the drilling control.

Typically in this kind of drilling equipment the feed channels are equipped with counterbalance valve. The purpose of the counterbalance valve is to prevent unwanted movement of the rock drill by closing the return channel if there is no control signal or control pressure, which would open the counterbalance valve.

BRIEF DESCRIPTION OF THE INVENTION

An object of the invention is to provide a novel and improved method and apparatus for controlling rock drilling.

The method is defined by measuring the feed speed;

measuring the rotation pressure;

controlling the feed force in relation to the measured feed speed and the measured rotation pressure; and controlling the percussion power in relation to the feed force so that when the feed force is decreased below a predetermined value the percussion power is decreased and when the feed force again increases the percussion power is correspondingly increased.

The apparatus is defined by that in the return channel there is a load control valve in the feed return channel of the feed motor (3), the load control valve having a first position, in which the pressure liquid flow in the feed return channel is closed and a second position which the valve takes when receiving a corresponding control signal, in which the pressure liquid flow from the feed motor in the feed return channel is connected open, that the load control valve is connected to control counter pressure in the feed return channel when receiving a corresponding control signal and that the control unit is arranged to control the load control valve on the basis of the measured values.

The idea of the method is that a maximum feed force is first determined and set to the drilling control. The maximum feed force is in practice determined by setting the maximum pressure of the pressure liquid, which affects the feed cylinder. According to one embodiment of the invention the maximum feed force is affecting only, when the feed speed is zero. According to the idea of this invention the value of the feed speed is used to decrease the feed force, when the feed speed increases. Further according to the idea of the invention the rotation torque is used to control the feed force so that the feed force is decreased when the rotation torque is increased. Further the percussion power is controlled in relation to the feed force so that when the feed force is decreased the percussion power is decreased and when the feed force again increases the percussion power is correspondingly increased. In one embodiment of the method a predetermined value lower than the maximum feed force is set for the feed force and the decrease of the percussion power starts only when the feed force drops below that preset value.

The idea of the apparatus is that the return feed pressure channel is equipped with a load control valve with which the flow or the counter pressure of the pressure liquid returning from the feed motor can be controlled so that there is a suitable counter pressure which controls the movement of the feed and that the load control valve is controlled by the control unit on the basics of the measured speed and/or a measured rotation pressure. Further the idea is that the pressure of the pressure liquid supplied to the percussion device is controlled at the same time under basis or feed speed/or rotation pressure so that when the resistance increases the pressure of the pressure liquid is decreased and vice versa.

An advantage of the invention is that changes in the drilling conditions can be sensed and used in controlling the drilling effectively and automatically.

BRIEF DESCRIPTION OF THE DRAWINGS

The invention will be described in closer detail in the accompanying drawings, in which:

FIG. 1 is a schematic side view showing a rock-drilling unit,

FIG. 2 is a schematically presented diagram of the apparatus according to the invention, FIG. 3 is another schematically presented diagram of the apparatus according to the invention, FIG. 4 is still another schematically presented diagram of the apparatus according to the invention and FIGS. 5*a*-5*c* show schematically how the relation between the feed force and the rotation torque may be adjustable.

For the sake of clarity, the figures show the invention in a simplified manner. Same reference numerals identify similar elements.

DETAILED DESCRIPTION OF THE INVENTION

Figure 5A:
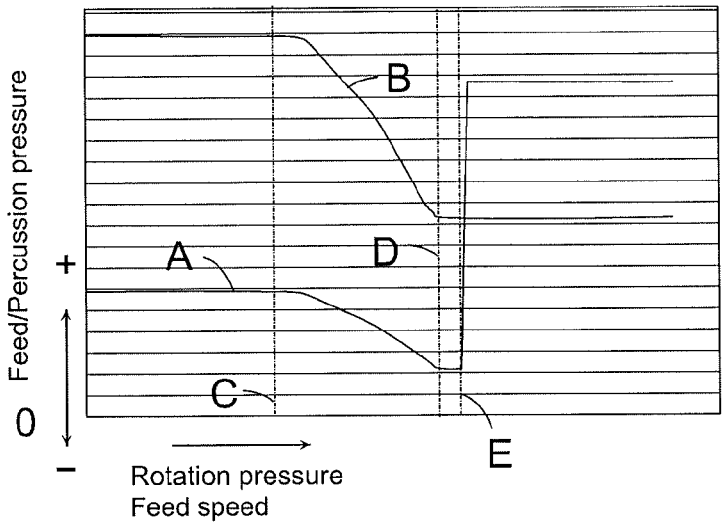

The rock-drilling unit shown in FIG. 1 comprises a rock drill 1 arranged on a feed beam 2. The rock drill 1 can be moved in the longitudinal direction of the feed beam 2 by means of a feed motor 3. The feed motor 3 may be e.g. a pressure liquid operated cylinder or motor and it is arranged to affect the rock drill 1 through a power transmission element, such as a chain or a wire. The feed motor 3 may be a pressure liquid cylinder or a pressure liquid motor operated by pressure liquid in a manner known as such. The rock drill 1 and a tool 9 connected thereto are pressed against rock 10 by using a feed force of a desired magnitude. The feed beam 2 may be movably arranged at a free end of a drilling boom 6 belonging to the rock drilling apparatus. The rock drill 1 comprises at least a percussion device 7 and a rotating motor 8. The percussion device 7 is used for generating stress waves like impact pulses to the tool 9 connected to the rock drill 1, the tool delivering the stress waves to the rock 10. An outermost end of the tool 9 is provided with a drill bit 11, the bits therein penetrating the rock 10 due to the stress waves, causing the rock 10 to break. Furthermore, the tool 9 is rotated with respect to its longitudinal axis, which enables the bits in the drill bit 11 always to be struck at a new point in the rock 10. The tool 9 is rotated by means of the rotating motor 8, which may be e.g. a pressure liquid operated device or an electric device. The tool 9 may comprise several drill rods 12 arranged on each other consecutively. Screw joints may be provided between the drill rods 12. In the solution of the invention, the percussion device 7 is hydraulically operated. The percussion device 7 may comprise a percussion piston, which is moved to and fro by means of a pressure liquid and which is arranged to strike upon a tool or a shank adapter arranged between a tool and a percussion piston. Of course, the invention may also be applied in connection with pressure liquid operated percussion devices 7 wherein stress waves are generated in a manner other than by means of a percussion piston moved to and fro like by force created by pressure liquid pulses that compress the tool including the drill rods so that a stress wave is created through the tool to the rock.

FIG. 2 shows a schematic presentation of one embodiment of an apparatus according to this invention. A hydraulic circuit comprises one or more pumps 20, in FIG. 2 three pumps as an example, pumping pressure liquid from reservoir 13 and for generating the necessary pressure and flow for the pressure liquid. When necessary, the number of pumps 20 may be only one or more than one. Furthermore, the pump 20 may be a fixed displacement pump or a variable displacement pump which both are commonly known and used for this purpose. Pressure liquid is supplied from the pump 20 via a feed control valve 21, which is a proportional valve, to the feed motor 3, in the figure as an example a feed cylinder, which is connected to the rock drill 1 for feeding it forward to the rock during drilling and retracting it when necessary. Further the pressure liquid is conveyed from the pump 20 via a rotation control valve 22 to a rotation motor 8 for rotating tool 9 during drilling.

The hydraulic circuit of a feed cylinder can be connected as presented in the figure. Also it is possible to use a solution, in which the pressure liquid from the piston rod 3*b* side of the feed cylinder 3 is supplied to the other side of the piston 3*a* when the piston 3*a* is pushed towards the piston rod 3*b* side of the feed cylinder 3. This kind of connection is commonly known as a differential connection. When using a normal rotating feed motor in connection with a commonly used chain or other means to move the rock drill, the feed motor can be hydraulically connected in any manner known per se in order to operate it.

The rotation pressure channel 23 via which in the pressure liquid is conveyed to the rotation motor 8 during drilling and the rotation return channel 24 are connected to the rotation control valve 22, which controls the flow of the pressure liquid. When opening the threads between the drill bit 11 and the rod 12 or between two rods 12 the channels 23 and 24 can be changed with the rotation control valve 22 in order to rotate the rods 12 to the opposite direction in a manner known per se.

The spool of the feed control valve 21 through which the pressure liquid flows to the feed motor 3 and away from the other side of the piston 3*a* of the feed motor 3 controls the amount of the pressure liquid flow. The amount of flow can be controlled by changing the spool position in relation to valve inlet and outlet channels. Thus the sizes of the openings between the spool and the channels of the valve control the flow. The construction and the operation of this kind of valves are commonly known for a man skilled in the art and need therefore no more detailed description.

FIG. 2 discloses also a load control valve 36 connected to the feed return channel 28 of feed motor 3. The load control valve is an electrically controlled proportional valve and it controls the liquid flow in the feed return channel 28. The load control valve 36 can also operate as a counterbalance valve by preventing the liquid flow in the feed return channel 28 when the valve receives no control signal. When the load control valve 36 receives an opening control signal, the load control valve changes to a second position and opens the pressure liquid flow in the feed return channel 28. The purpose of the load control as a counterbalance valve is to prevent to movement of the rock drill and the tool relative to the feed beam of the apparatus if a control signal disappears or the drilling operation otherwise is stopped.

In the apparatus there is a control unit 30 controlling the drilling. The feed speed is measured with the speed sensor 31, which is located to the feed motor 3 or the feed beam in a manner known per se. The feed speed can be measured directly with a speed sensor. Also the feed speed can be measured with one or more position sensors whereby the control unit 30 calculates the feed speed in relation to the change of the position. Further the feed speed can be measured indirectly by measuring the liquid flow to the feed motor or cylinder, measuring the pressure drop in the liquid supply channel over a restrictor or any as such known method.

The feed pressure is measured in the feed pressure channel 27 conveying pressure liquid from the feed control valve 21 to the feed motor 3 during forward feed with a pressure sensor 32 when drilling. Since the spool of the feed control valve 21 can restrict the liquid flow, the pressure of the feed return channel 28 conveying pressure liquid back from the feed motor 3 to the feed control valve 21 during drilling must also be measured by sensor 34. On the basis of the pressure difference between the feed pressure channel 27 and the feed return channel 28 the feed force can be calculated. Also the rotation torque is defined by measuring the rotation pressure of the liquid in the rotation pressure channel 23 with a sensor 33. The rotation torque is relative to the rotation pressure whereby the rotation pressure can be used as a parameter corresponding to the rotation torque for controlling the drilling. Every sensor is connected to the control unit 30, which controls then the feed control valve on the basis of the sensed values. The control wires or cables have been marked commonly with dashed lines 35.

The control unit 30 senses the rotation pressure, the feed speed and defines the feed force as a pressure difference between channels 27 and 28.

When starting drilling the spool of the feed control valve 21 is set to a position in which pressure liquid flows from pump 20 to the feed pressure channel 27. The pressure value $p_1$ in the feed pressure channel 27 via which the pressure liquid is conveyed to the feed motor 3 for feeding rock drill 1 forward is set to a predetermined value, which defines the maximum feed force. The feed speed is dependent on the liquid volume flow to the feed motor 3.

If the drilling resistance is small the feed speed increases. Since the pressure liquid flow increases through the feed control valve 21 the pressure drop over the valve increases as a result of the flow increases. As a result the pressure difference between the feed pressure channel 27 and the feed return channel 28 via which pressure liquid is returned from the feed motor decreases and the feed force acting to the rock drill decreases correspondingly since the feed force is a result of the pressure difference acting on piston 3*a*. In case of soft material or broken stone or when drilling downwards and the weight of drill rods is big the feed may start rushing forward. This is, however, limited by that the openings of the feed control valve 21 for pressure liquid flow to and from the feed motor 3 is restrict the flow. When the flow increases, the pressure drop over the feed control valve 21 also increases, which causes a limited feed speed and thus decreases the feed speed and force. This functions also in case of drilling downwards and when the weight of drill rods is big the mass of rods have to be held in order to avoid too high a feed force.

Correspondingly, if the feed speed decreases because of higher resistance, the flow of the pressure liquid decreases and the pressure acting the piston of the feed motor increases and thus causes increasing of the feed force. Again if the rotation resistance decreases the sensed value of the pressure makes the control unit 30 to control the feed pressure control valve 37 increasing the pressure in the feed pressure channel 27 and thus the feed force.

During drilling the control unit 30 receives signals from each of the sensors and defines on the basis of the sensor values the necessary control signals. On the basis of the values of the feed speed and the rotation pressure the control unit 30 controls the feed force by controlling the pressure liquid supply to the feed motor 3 and/or back from the feed motor 3. In practice this is done by restricting the pressure liquid flow more or less. For this purpose the load control valve 36 is also used as a part of the feed force control. In this embodiment the load control valve 36 is basically designed to operate as a load holding valve. Thus without a control signal it prevents the load formed from the rock drill and the tool moving relative to the feed beam by closing the pressure liquid flow away from the feed motor 3. The load control valve 36 is as such a proportional valve, which is controlled by the control unit.

The measured values from the sensors are fed to the control unit 30, which on the basis of these values controls a feed pressure control valve 37 which is electrically controlled. The feed pressure control valve 37 controls the pressure in a control channel 42 and via that a pressure compensator 39 and the load control valve 36. The pressure compensator 39 controls the pressure of the pressure liquid supplied via the feed control valve 21 into the feed pressure channel 27. It is also possible to have a separate pressure control valve like the feed pressure control valve 37 to separately to control the load control valve 36. The normal feed speed is preset to a value, below which the feed speed normally is by setting a maximum pressure value with the pressure compensator 39.

If the feed speed exceeds that preset value the control unit 30 controls the feed pressure control valve 37 and via it the pressure compensator 39 so that it starts decreasing the pressure directly in the feed pressure channel 27.

Alternately the control unit 30 controls the feed pressure control valve 37 to restrict via the load control valve 36 the flow of the pressure liquid in the feed return channel 28 thus increasing the pressure loss over the load control valve 36 and thus the counter pressure in the feed return channel 28.

The operating order of the pressure compensator 39 and the load control valve 36 can be selected by presetting their operating pressure threshold values suitably different.

The control can be done so that either of the valves is controlled first and the other one it taken into use thereafter. Also the control can be done by controlling both the pressure compensator 39 and the load control valve 36 all the time simultaneously.

As a result the pressure difference over the feed motor 3 and thus the feed force is decreased.

Correspondingly, if sensor 33 measures an increase in the rotation pressure, the control unit 30 controls the feed pressure control valve 37 and via it the load control valve 36 to restrict the flow of the pressure liquid from the feed motor thus increasing the pressure loss or controls the pressure compensator 39 for controlling the pressure or both.

In this embodiment the feed control valve 21 is normal proportional bi-directional valve which is also controlled by the control unit 30. It is controlled hydraulically by using electrically controlled pilot valves 40 and 41 between the control unit 30 and feed control valve 21. The feed control valve 21 may restrict the maximum inlet flow to the feed motor 3 and controls also the reverse feed of the system.

FIG. 2 further presents a percussion device 7 which is operated with pressure liquid supplied by pump 20 along percussion pressure channel 43. A percussion control valve 44 in the percussion pressure channel 43 controls the pressure liquid supply to the percussion device 7. The percussion pressure of the pressure liquid in percussion pressure channel 43 is measured with a sensor 45, which is connected to the control unit 30. Control unit 30 is further connected to the percussion control valve 44 and via it to control the percussion pressure of the pressure liquid supplied to the percussion device 7 according to the method of this invention. The pressure liquid returns to the reservoir 13 along a percussion return channel 46 via the percussion control valve 44

FIG. 3 shows schematically another embodiment of the invention with an electric control of the feed force. In this embodiment there is a control unit 30 controlling the drilling. The necessary values of the feed speed and the rotation pressure and the feed force are measured or calculated as described in connection with FIG. 2. Every sensor is connected to the control unit 30. The feed control valve 21 is directly electrically controlled without any pilot valves as also the load control valve 36. The control wires or cables have been marked commonly with 35. In this embodiment the pressure compensator 39 is electrically controlled but operates basically similarly as the pressure compensator 39 in FIG. 2.

FIG. 4 shows schematically another embodiment of the invention. In this embodiment there is a normal counterbalance valve 47 which closes both channels 27 and 28 to the feed motor 3 if there is no pressure in either of the channels. Further, there is another kind of load control valve namely an electrically controlled counter pressure control valve 36', which is used to set a counter pressure to the feed return channel 28 of the feed motor 3. This counter pressure control valve 36' is controlled by the control unit in order to control the counter pressure and as a result of that also feed speed. The supply pressure of the liquid in the feed pressure channel 27 can be set separately and the feed pressure or speed is controlled by the counter pressure control valve 36' so that the counter pressure controls the counter pressure, which defines the pressure over the feed motor 3 and thus the value which corresponds to the feed force. This correspondingly affects the flow of the pressure liquid. The control is otherwise done as described earlier in the relation to FIGS. 2 and 3 on the basis of feed speed and the rotation pressure. This embodiment is especially useful when drilling long holes downwards, whereby counter pressure control valve 36' can be used to preset a suitable counter pressure to compensate the weight of drills string and the drilling machine so that they stay in balance in the overfeed situation caused by big mass of the system.

Further, parallel to the counter pressure control valve 36' there is a non-return valve 48 which allows pressure liquid flow from the feed control valve 21 to feed motor 3 passing by the counter pressure control valve 36' when supplying pressure liquid along the feed return channel 28 to the feed motor 3 during a return movement. During the return movement the pressure liquid from the feed motor 3 returns through the feed pressure channel 27. The non-return valve 48 prevents pressure liquid flow through it otherwise and thus the liquid flow from feed motor 3 in normal drilling is controlled by the counter pressure control valve 36'. The system can also operate without counterbalance valve 47.

FIG. 4 also shows another embodiment to control the pressure of the pressure liquid supplied via percussion pressure channel 43 to the percussion device 7. In this embodiment there is a normal on/off valve 49 for opening and closing the pressure liquid feed to the percussion device 7. There is also a pressure control valve 44', with which the pressure of the pressure liquid supplied to the percussion device 7 is separately controlled by the control unit 30 according to the method described above. The pressure control valve 44' can also be connected to a commonly known load sensing line of a variable piston pump 20 in a manner known per se. Further the solution for controlling the feed pressure can be applied also to control the percussion pressure.

Figure 5B:
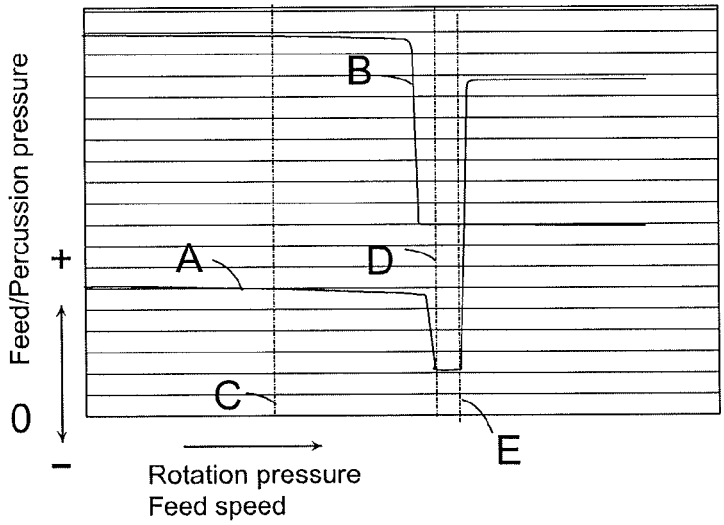
Figure 5C:
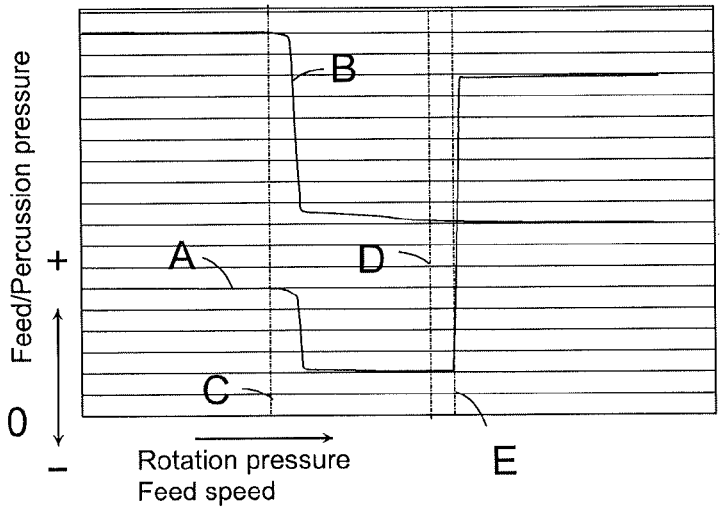

FIGS. 5*a*-5*c* show schematically how the relation between the feed force and the rotation pressure may be adjustable.

FIG. 5*a* shows how the rotation torque, feed force ad the percussion power depend of each other in the method of this invention. Since the rotation torque corresponds to the rotation pressure, which is the pressure of the pressure liquid in the rotation pressure channel 23 along which pressure liquid is supplied to the rotation motor 8 during the forward feed, the rotation pressure represents the rotation torque. The rotation pressure and the feed speed values are presented in the horizontal axis. The feed force and the percussion power are presented on the vertical axis. Feed force is relative to the feed pressure and curve A presents the feed force as feed pressure in the feed pressure channel 27. Curve B presents the percussion power as percussion pressure in channel 43 since the percussion power is relative to the percussion pressure.

When drilling is started the rotation pressure as also the feed speed has a preset target value which is may be presented for both with dotted line C. Also during normal drilling the percussion power is in its preset maximum value.

If the feed speed increases over the preset value C, the feed force and the percussion power start to decrease as presented in curves A and B. When the feed speed again decreases the feed force and the percussion power correspondingly increase back to their preset values along curves A and B. Correspondingly, if the feed speed decreases below the preset value C, the feed force and the percussion power start may increase, if they at the moment are below their preset maximum value.

If the rotation torque increases, the rotation pressure increases from the target value C. Simultaneously the feed force starts to decrease according to curve A. Substantially simultaneously the percussion power starts to decrease like curve B shows.

If the torque continues to increase, the rotation pressure increases to a preset value D shown as a dotted line, whereby the feed is reversed and the feed force during retract is in the beginning kept at the low value until the rotation torque reaches value E. However, if rotation torque and thus the rotation pressure still increases, the retracting feed force is raised to a predetermined high value when the rotation torque is at a predetermined value E presented as a dotted line.

When the rotation torque and thus the rotation pressure for some reason starts to decrease, the feed force and the percussion power start to increase, until a normal drilling situation has been reached. If the feed was retracting it is first changed to forward feed and thereafter the feed speed also starts increasing while the rotation torque decreases. In the method the control system may have adjustable sensitivity for different circumstances. In FIG. 5*a* the sensitivity has been selected so that the relation between the feed force and the rotation torque is in a medium position. In this situation the feed force starts decreasing almost immediately when the rotation torque starts to increase. The decrease of the feed force follows smoothly the increase of the rotation torque.

In FIG. 5*b* the relation between the feed force and the rotation torque has been adjusted to be low. This means that the sensitivity of the control between the feed force and the torque is low. Thus the increase in the torque must be significant before the feed force is decreased. The feed speed can, however, continue decreasing in the same way as presented in FIG. 5*a*.

In FIG. 5*c* the relation between the feed force and the rotation torque and/or the feed speed is set high. The feed force starts decreasing almost immediately when the rotation torque or the feed speed starts to increase and drops fast.

FIGS. 5*b* and 5*c* show schematically examples of the extreme ways to control the drilling according to this method. The operation can be adjustable between these examples.

In all situations, if the rotation torque is increased to a predetermined value, the feed is reversed. Correspondingly in all situations, when the rotation torque again decreases, the feed force increases similarly as it decreased when the rotation torque increased. The effect of the feed speed value to the feed force and/or the percussion power may be similar to the effect of the rotation pressure value. Their effect may also be different e.g. so that the effect of rotation pressure affect them like presented in FIG. 5*b* and the feed speed affect like in FIG. 5*c* or vice versa. The effect of both parameters can be adjustable in different ways.

The invention has been described in the specification only schematically. In practice it can be implemented in many different practical ways and thus the protection area is defined by the claims of the application. So any details shown in different figures and explained in the specification can be combined with the solutions in other figures.

The drawings and the related description are only intended to illustrate the idea of the invention. In its details, the invention may vary within the scope of the claims.

The invention claimed is:

1. A method for controlling rock drilling wherein a pressure liquid operated percussion device belonging to a rock drill machine delivers stress waves to rock through a tool, wherein the rock drill machine and the tool are simultaneously pushed against the rock by means of a feed motor, and the tool is simultaneously rotated by means of a rotation motor, the method comprising:

determining a maximum feed force;

supplying pressure liquid to the feed motor along a feed pressure channel and away from the feed motor along a feed return channel;

supplying pressure liquid to the percussion device along a percussion pressure channel and away from the percussion device along a percussion return channel;

supplying pressure liquid to the rotation motor along a rotation motor pressure channel and away from the rotation motor along a rotation motor return channel;

controlling the feed force in relation to a feed speed so that when the feed speed is increased the feed force is decreased and vice versa;

controlling the feed force in relation to a rotation torque so that when the rotation torque is increased the feed force is decreased and vice versa;

measuring the feed speed; measuring a rotation pressure;

controlling the feed force in relation to the measured feed speed and the measured rotation pressure; and controlling a percussion power in relation to the feed force so that when the feed force is decreased below a predetermined value the percussion power is decreased and when the feed force again increases the percussion power is correspondingly increased.

2. A method as claimed in claim 1, the method further comprising using the maximum feed force value as the predetermined feed force value.

3. A method as claimed in claim 1, the method further comprising controlling the feed force in a predetermined relation to the feed speed and/or the rotation pressure.

4. A method as claimed in claim 2, the method further comprising controlling the feed force in a predetermined relation to the feed speed and/or the rotation pressure.

5. A method as claimed in claim the 1, the method further comprising controlling the pressure of the pressure liquid supplied to the percussion device in a predetermined relation to the feed force.

6. A method as claimed in claim 1, the method further comprising measuring the feed speed and the rotation pressure electrically and controlling the drilling with an electrical control device.

7. A method as claimed in claim 1, the method further comprising using a separate load control valve to control the feed force.

8. A method as claimed in claim 7, the method further comprising using the load control valve for the control of the feed force so that that when the feed speed and/or rotation pressure is increased the load control valve is controlled to restrict the flow of the pressure liquid to the feed motor.

9. A method as claimed in claim 7, the method further comprising using the load control valve for the control of the feed force so that that when the feed speed and/or rotation pressure is increased the load control valve is controlled to restrict a counter pressure in the feed return channel of the feed motor.

10. A method as claimed in claim 7, wherein the load control valve is hydraulically controllable and wherein the method further comprises using a separate pressure compensator controlled by the control unit to control the load control valve.

11. A method as claimed in claim 7, the method further comprising adjusting the relation between the feed force and the rotation pressure.

12. An apparatus for controlling rock drilling with a pressure liquid operated rock drilling machine, a drilling tool being attachable to the rock drilling machine, the apparatus comprising:

a percussion device for creating stress waves to the tool;

a percussion pressure channel and a percussion return channel for supplying pressure liquid to the percussion device and away;

a rotation motor for rotating the tool;

a rotation pressure channel and a rotation return channel for supplying pressure liquid to the rotation motor and away;

a feed motor for feeding the rock drilling machine to the drilling direction and to reverse direction;

a feed pressure channel and a feed return channel for supplying pressure liquid to the feed motor and away;

a feed control valve for controlling the supply of the pressure liquid to the feed motor;

a rotation control valve for controlling the supply of the pressure liquid to the rotation motor;

a percussion control valve for controlling the supply of the pressure liquid to the percussion device;

measuring equipment for measuring the feed speed and/or the feed position and to measure the pressure of the pressure liquid supplied to the feed motor and for measuring the pressure of the pressure liquid supplied to the rotation motor; and a control unit to which the measuring equipment is connected and which is connected to control the feed control valve the rotation control valve and the percussion control valve on the basis of the measured values, wherein in the return channel there is a load control valve in the feed return channel of the feed motor the load control valve having a first position, in which the pressure liquid flow in the feed return channel is closed and a second position which the valve takes when receiving a corresponding control signal, in which the pressure liquid flow from the feed motor in the feed return channel is connected open, wherein the load control valve is connected to control counter pressure in the feed return channel when receiving a corresponding control signal, and wherein the control unit is arranged to control the load control valve on the basis of the measured values.

13. An apparatus as claimed in claim 12, wherein the load control valve is a proportional valve.

14. An apparatus as claimed in claim 13, wherein the control unit is arranged to control the load control valve on the basis of the measured values in such a way that, when the feed speed and/or rotation pressure increase, the control unit controls the load control valve so that the feed force decreases and correspondingly when the feed speed and/or rotation pressure decrease, the control unit controls the load control valve so the feed force increases, and wherein the control unit is arranged to control the percussion control valve so that when the feed speed and/or rotation pressure increase, the pressure of the pressure liquid supplied to the percussion device decreases and correspondingly when the feed speed and/or rotation pressure decrease, the pressure of the pressure liquid supplied to the percussion device increases.

15. An apparatus as claimed in claim 14, wherein the load control valve is pressure liquid pressure controlled.

16. An apparatus as claimed in claim 12, wherein the apparatus comprises a separate pressure compensator for controlling the pressure of the pressure liquid supplied to the feed motor and that the control unit is connected to control both the pressure compensator and the load control valve simultaneously.

17. An apparatus as claimed in claim 16, wherein the apparatus comprises a separate electrically controlled feed pressure control valve, which is connected to hydraulically control the both the pressure compensator and the load control valve.

18. An apparatus as claimed in claim 12, wherein the load control valve is electrically controlled.

19. An apparatus as claimed in claim 12, that wherein the control unit is arranged to control the feed control valve and/or the load control valve on the basis of the feed speed and/or rotation pressure.

20. An apparatus as claimed in claim 12, wherein the load control valve is a separate counter pressure control valve.

21. An apparatus as claimed in claim 20, wherein the counter pressure control valve is electrically controlled.

22. An apparatus as claimed in claim 20, wherein the control unit is arranged to control the counter pressure control valve on the basis of the measured values in such a way that, when the feed speed and/or rotation pressure increase, the control unit controls the counter pressure control valve so that the feed force decreases and correspondingly when the feed speed and/or rotation pressure decrease, the control unit controls counter pressure control valve so the feed force increases, and wherein the control unit is arranged to control the percussion control valve so that when the feed speed and/or rotation pressure increase, the pressure of the pressure liquid supplied to the percussion device decreases and correspondingly when the feed speed and/or rotation pressure decrease, the pressure of the pressure liquid supplied to the percussion device increases.

23. An apparatus as claimed in claim 20, wherein in the control unit is arranged to preset a predetermined pressure value to the counter pressure control valve and to control the feed by controlling the feed control valve.

24. An apparatus as claimed in claim 23, wherein in down hole drilling the control unit is arranged to control the counter pressure control valve in such a way that it presets the pressure value of the counter pressure control valve to correspond the force created by the weight of the drill string and the rock drill.

25. An apparatus as claimed in claim 12, wherein the control unit is arranged to define a rotation torque on the basis of the measured pressure of the pressure liquid in the rotation feed channel.

* * * * *